US008220280B2

(12) United States Patent
Chang et al.

(10) Patent No.: US 8,220,280 B2
(45) Date of Patent: Jul. 17, 2012

(54) AIR CONDITIONING APPARATUS AND METHOD FOR DETERMINING THE AMOUNT OF REFRIGERANT OF AIR-CONDITIONING APPARATUS

(75) Inventors: Seung Yong Chang, Seoul (KR); Chi Woo Song, Seoul (KR); Sung Hwan Kim, Seoul (KR); Chang Min Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 673 days.

(21) Appl. No.: 12/320,787

(22) Filed: Feb. 4, 2009

(65) Prior Publication Data

US 2009/0211281 A1 Aug. 27, 2009

(30) Foreign Application Priority Data

Feb. 5, 2008 (KR) ..... 10-2008-0011797

(51) Int. Cl.
*F25B 45/00* (2006.01)
*F25B 49/00* (2006.01)

(52) U.S. Cl. ..... 62/149; 62/196.1; 62/513

(58) Field of Classification Search ..... 62/113, 62/127, 129, 149, 160, 196.1, 197, 199, 513, 62/77
See application file for complete search history.

(56) References Cited

U.S. PATENT DOCUMENTS 5,214,918 A 6/1993 Oguni et al.
7,752,855 B2 * 7/2010 Matsuoka et al. ..... 62/149
7,954,333 B2 * 6/2011 Yoshimi ..... 62/129

FOREIGN PATENT DOCUMENTS

WO WO 2007/069581 A1 6/2007
WO WO 2007/069624 A1 6/2007
WO WO 2007126055 A1 * 11/2007

* cited by examiner

*Primary Examiner* — Marc Norman
(74) *Attorney, Agent, or Firm* — McKenna Long & Aldridge LLP

(57) ABSTRACT

In a refrigerant amount determining method of an air-conditioning apparatus, when a refrigerant amount determining mode is requested to be performed, whether or not the amount of refrigerant in the air-conditioning apparatus can be automatically determined. Thus, a user can easily check whether or not the refrigerant charged in the air-conditioning apparatus is excessive or insufficient.

15 Claims, 6 Drawing Sheets

AIR CONDITIONING APPARATUS AND METHOD FOR DETERMINING THE AMOUNT OF REFRIGERANT OF AIR-CONDITIONING APPARATUS

CROSS-REFERENCE TO RELATED APPLICATION

This application claims the benefit of Korean Patent Application No. 10-2008-0011797 filed on Feb. 5, 2008, which is hereby incorporated by reference in its entirety as if fully set forth herein.

BACKGROUND OF THE INVENTION

1. Field of the Invention

The present invention relates to an air-conditioning apparatus and a method for determining the amount of refrigerant of the air-conditioning apparatus, and more particularly, to an air-conditioning apparatus and a refrigerant amount determining method of an air-conditioning apparatus to accurately determine whether or not the amount of refrigerant in the air-conditioning apparatus is proper.

2. Description of the Related Art

As for a multi-air-conditioning apparatus, if a refrigerant flowing in the multi-air-conditioning apparatus is more than or less than a fixed quantity, a system performance is degraded, and worse, the multi-air-conditioning apparatus may be damaged. In the related art, a manometer (or a pressure gauge) is installed at a particular position of the air-conditioning apparatus to determine overs and shorts of the amount of refrigerant based on the pressure of the refrigerant detected by the manometer. However, only an expert or a technician of the air-conditioning apparatus is able to determine the overs and shorts of the refrigerant by using such method, so using of the method is not convenient for general users. In addition, even the technician has no choice but to determine the overs and shorts of the refrigerant indirectly, lowering the reliability of the results of the determination of the overs and shorts of the refrigerant. Thus, in most cases, the refrigerant in the air-conditioning apparatus is wholly removed out, and then, the air-conditioning apparatus is charged with a new refrigerant. Such unnecessary re-charging of the air-conditioning apparatus with the new refrigerant takes much time and incurs much cost. In addition, the operation of the air-conditioning apparatus should be stopped for the process of re-charging the refrigerant, which causes user inconvenience.

SUMMARY OF THE INVENTION

Thus, an object of the present invention is to provide an air-conditioning apparatus and method for determining the amount of refrigerant of an air-conditioning apparatus capable of accurately determining whether or not the amount of refrigerant in the air-conditioning apparatus is proper.

To achieve the above object, there is provided a method for determining the amount of refrigerator of an air-conditioning apparatus, including: receiving a request for performing a refrigerant amount determining mode to determine whether or not a refrigerant charged in the air-conditioning apparatus is proper; if it is determined that the refrigerant amount determining mode can be started while the air-conditioning apparatus is operated in a first operation mode, changing the air-conditioning apparatus to a second operation mode to stabilize the air-conditioning apparatus; and when the air-conditioning apparatus is stabilized, determining whether or not the refrigerant charged in the air-conditioning apparatus is proper.

The first operation mode may be a mode for operating the air-conditioning apparatus in a blowing mode. After the air-conditioning apparatus is operated in the blowing mode, if an indoor temperature and an outdoor temperature are within a pre-set temperature range, respectively, in a state that pre-set condition is met, it may be determined that the refrigerant amount determining mode can be started.

The air-conditioning apparatus may be a multi-air-conditioning apparatus including a plurality of indoor units, and the second operation mode may be an all-room cooling operation mode in which the plurality of indoor units are operated for cooling, or an all-room heating operation mode in which the plurality of indoor units are operated for heating.

In stabilizing the air-conditioning apparatus, if a plurality of operation variables of the air-conditioning apparatus are within pre-set ranges, it may be determined that the air-conditioning apparatus has been stabilized.

Whether or not the refrigerant is proper may be determined based on the plurality of operation variables of the air-conditioning apparatus. In this case, whether or not the refrigerant is proper may be determined by using fuzzy data previously stored with respect to the plurality of operation variables.

The method for determining the amount of refrigerant of the air-conditioning apparatus may further include: visually displaying whether or not the charged refrigerant is proper.

In the air-conditioning apparatus and the method for determining the amount of refrigerant of the air-conditioning apparatus, when performing of the refrigerant amount determining mode is requested, whether or not the amount of refrigerant in the air-conditioning apparatus is proper may be automatically determined. Thus, a user can easily check whether or not the refrigerant charged in the air-conditioning apparatus is sufficient or insufficient.

In addition, because the refrigerant amount determining mode is performed after the air-conditioning apparatus is stabilized, the amount of refrigerant can be more accurately determined.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Air-conditioning apparatuses include a general air-conditioner that performs a cooling operation, a heater that performs a heating operation, a general heat pump type air-conditioner that performs both cooling and heating operations, and a multi-air-conditioner that cools/heats a plurality of indoor spaces. Hereinbelow, as an embodiment of the air-conditioning apparatus, the multi-air-conditioner will be described in detail.

Figure 1:
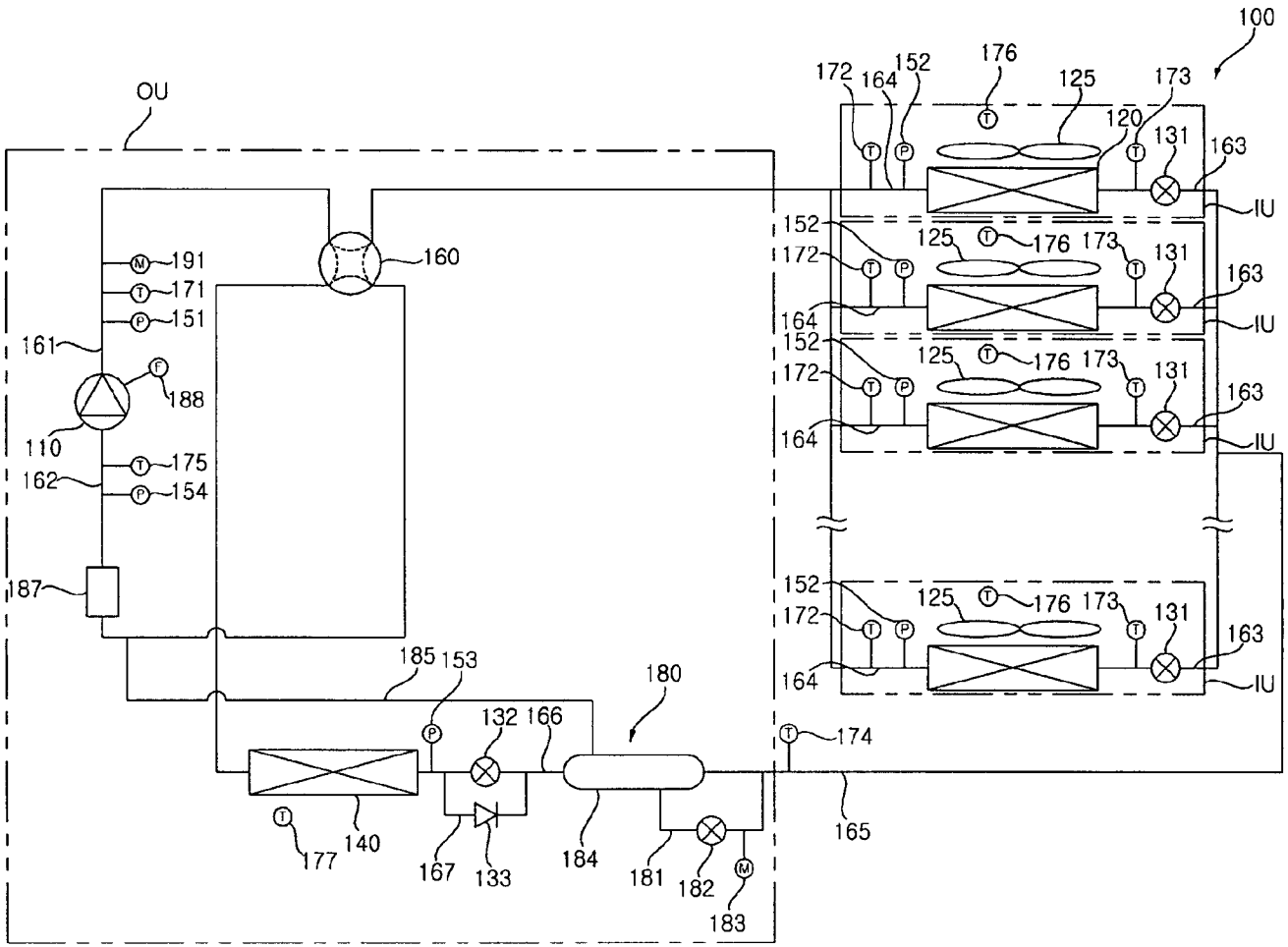
FIG. 1 shows a configuration of an air-conditioner applied for a refrigerant amount determining method of an air-conditioning apparatus according to an embodiment of the present invention.

FIG. 1 shows the configuration of a multi-air-conditioner (referred to as an 'air-conditioner', hereinafter) 100 applied for a refrigerator amount determining method of an air-conditioner according to an embodiment of the present invention. With reference to FIG. 1, the air-conditioner includes an outdoor unit (OU) and indoor units (IUs). The OU includes a compressor 110, an outdoor heat exchanger 140, an outdoor expansion valve 132, a supercooler 180, and a controller (not shown). Although the air-conditioner 100 is shown to have a single OU, but the present invention is not limited thereto and the air-conditioner 100 may include a plurality of OUs.

The IUs include an indoor heat exchanger 120, an indoor air blower 125, and an indoor expansion valve 131, respectively. The indoor heat exchanger 120 acts as an evaporator for a cooling operation and acts as a condenser for a heating operation. The outdoor heat exchanger 140 acts as a condenser for a cooling operation and acts as an evaporator for a heating operation.

The compressor 110 compresses an introduced low temperature low pressure refrigerant into a high temperature high pressure refrigerant. The compressor 110 may have various structures, and an inverter type compressor may be employed. A flow sensor 191, a discharge temperature sensor 171, and a discharge pressure sensor 151 are installed at a discharge pipe 161 of the compressor 110. A suction temperature sensor 175 and a suction pressure sensor 154 are installed at a suction pipe (or intake pipe) 162 of the compressor, and a frequency sensor 188 is installed to measure the frequency of the compressor 110. The OU is shown to have one compressor 110, but without being limited thereto, the present invention may include a plurality of compressors. An accumulator 187 is installed at the suction pipe 162 of the compressor 110 to prevent a liquid refrigerant from being introduced into the compressor 110.

A four-way valve 160, a flow path switching valve for switching the cooling and heating, guides the refrigerant compressed by the compressor 110 to the outdoor heat exchanger 140 for the cooling operation and guides the compressed refrigerant to the indoor heat exchangers 120 for the heating operation.

The indoor heat exchangers 120 are disposed in the respective indoor spaces. In order to measure the temperature of the indoor spaces, indoor temperature sensors 176 are installed. The indoor expansion valves 131 are units for throttling the introduced refrigerant when the cooling operation is performed. The indoor expansion valves 131 are installed at indoor inlet pipes 163 of the IUs. Various types of indoor expansion vales 131 may be used, and an electronic expansion valve may be used for user convenience. Indoor inlet pipe temperature sensors 173 are installed at the indoor inlet pipes 163. Specifically, the indoor inlet pipe temperature sensors 173 are installed between the indoor heat exchangers 120 and the indoor expansion valves 131, respectively. In addition, indoor outlet pipe temperature sensors 172 and indoor pressure sensors 152 are installed at the indoor outlet pipes 164.

The outdoor heat exchanger 140 is disposed in an outer space. An outdoor temperature sensor 177 is installed to measure the temperature of an outdoor space. A liquid pipe temperature sensor 174 is installed at a liquid pipe 165 that connects the outdoor expansion valve 132 and the IUs. The outdoor expansion valve 132, which throttles the refrigerant introduced when the heating operation is performed, is installed at the liquid pipe 165. A first bypass pipe 167 for allowing the refrigerant to bypass the outdoor expansion valve 132 is installed at an inlet pipe 166 connecting the liquid pipe 165 and the outdoor heat exchanger 140, and a check valve 133 is installed at the first bypass pipe 167. The check valve 133 allows the refrigerant to flow from the outdoor heat exchanger to the IUs when the cooling operation is performed, and prevents the refrigerant from flowing when the heating operation is performed. An outdoor pressure sensor 153 is installed at the inlet pipe 166.

The supercooler 180 includes a supercooling heat exchanger 184, a second bypass pipe 181, a supercooling expansion valve 182, and a discharge pipe 185. The supercooling heat exchanger 184 is installed at the inlet pipe 166. During the cooling operation, the second bypass pipe 181 bypasses the refrigerant discharged from the supercooling heat exchanger 184 to allow the refrigerant to be introduced into the supercooling heat exchanger 184. The supercooling expansion valve 182 is disposed at the second bypass pipe 181, throttles the liquid refrigerant introduced into the second bypass pipe 181 to lower the pressure and temperature of the refrigerant, so as for the refrigerant to be introduced into the supercooling heat exchanger 184. Accordingly, during the cooling operation, the high temperature condensed refrigerant which has passed through the outdoor heat exchanger 140 is supercooled by being heat-exchanged with the low temperature refrigerant which has been introduced through the second bypass pipe 181, and then flow to the IUs. The bypass refrigerant is heat-exchanged at the supercooling heat exchanger 184 and then introduced into the accumulator 187 through the discharge pipe 185. A bypass flowmeter 183 is installed at the second bypass pipe 181 to measure the amount of flow bypassed through the second bypass pipe 181.

Figure 2:
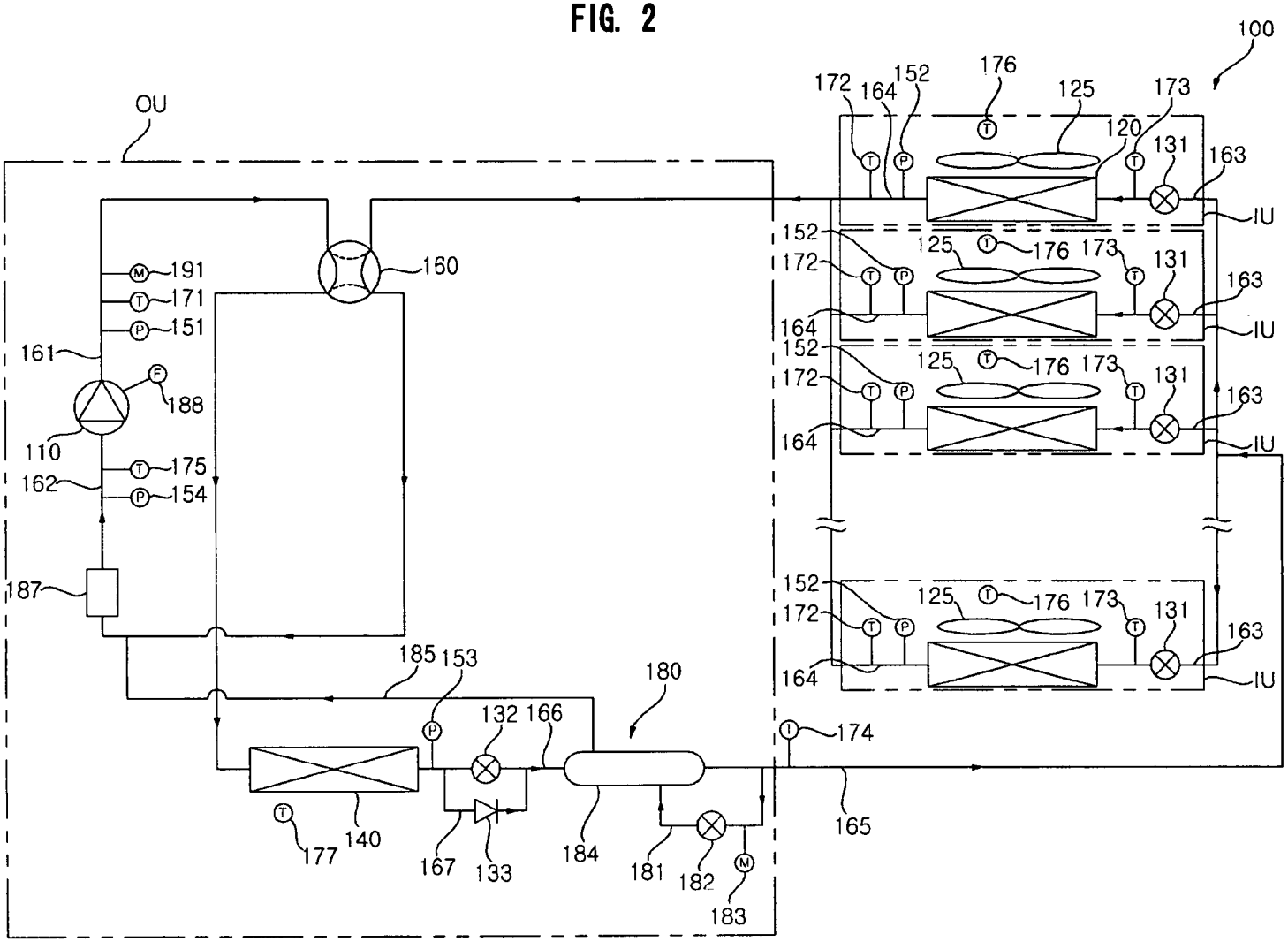
FIG. 2 illustrates a flow of a refrigerant when the air-conditioner is operated for cooling.

FIG. 2 shows a flow of the refrigerant when the air-conditioner 100 performs an all-room cooling operation. With reference to FIG. 2, the high temperature high pressure gaseous refrigerant discharged from the compressor 110 is introduced into the outdoor heat exchanger 140 via the four-way valve 160, and then condensed in the outdoor heat exchanger. The outdoor expansion valve 132 is completely open. The indoor expansion valves 131 of the IUs are open at an opening degree which has been set for refrigerant throttling. Thus, the refrigerant discharged from the outdoor heat exchanger 140 is first introduced into the supercooler 180 through the outdoor expansion valve 132 and the bypass pipe 133. The discharged refrigerant is supercooled by the supercooler 180 and then introduced into the IUs.

The refrigerant introduced into the IUs is throttled at the indoor expansion valve 131 and then evaporated at the indoor heat exchanger 120. The evaporated refrigerant is introduced into the suction pipe 162 of the compressor 110 through the four-way valve 160 and the accumulator 187. At this time, the indoor air blowers 125 are operated.

Figure 3:
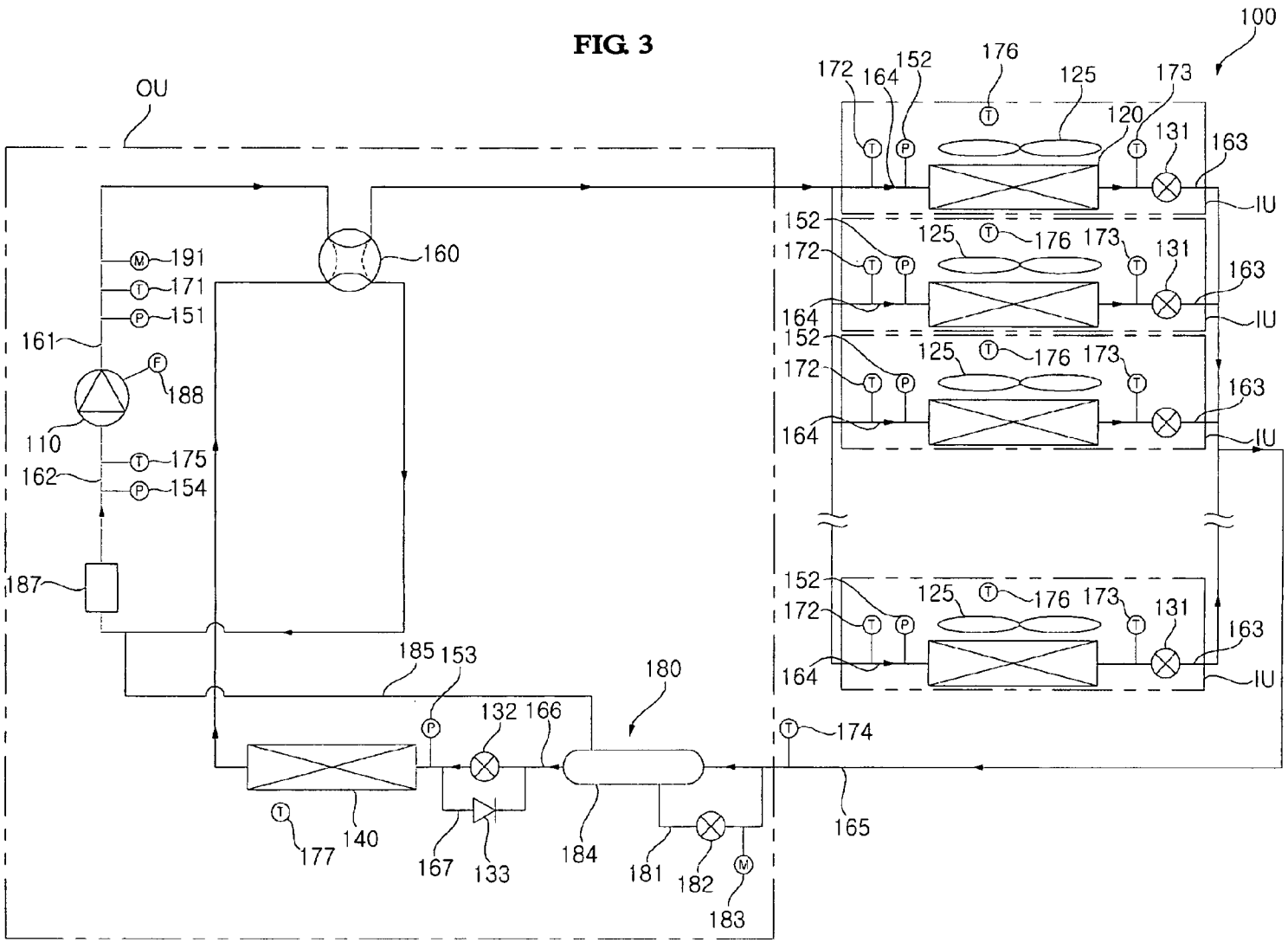
FIG. 3 illustrates a flow of a refrigerant when the air-conditioner is operated for heating.

FIG. 3 shows the flow of the refrigerant when the air-conditioner 100 performs all-room heating operation. With reference to FIG. 3, the high temperature high pressure gaseous refrigerant discharged from the compressor 110 is introduced into the IUs through the four-way valve 160. The indoor expansion valves 131 of the IUs are completely open. In addition, the supercooling expansion valve 192 is closed. Accordingly, the refrigerant introduced from the IUs is throttled at the outdoor expansion valve 132 and then evaporated from the outdoor heat exchanger 140. The evaporated refrigerant is introduced into the suction pipe 162 of the compressor 110 through the four-way valve 160 and the accumulator 187. At this time, the indoor air blowers 125 are operated.

Figure 4:
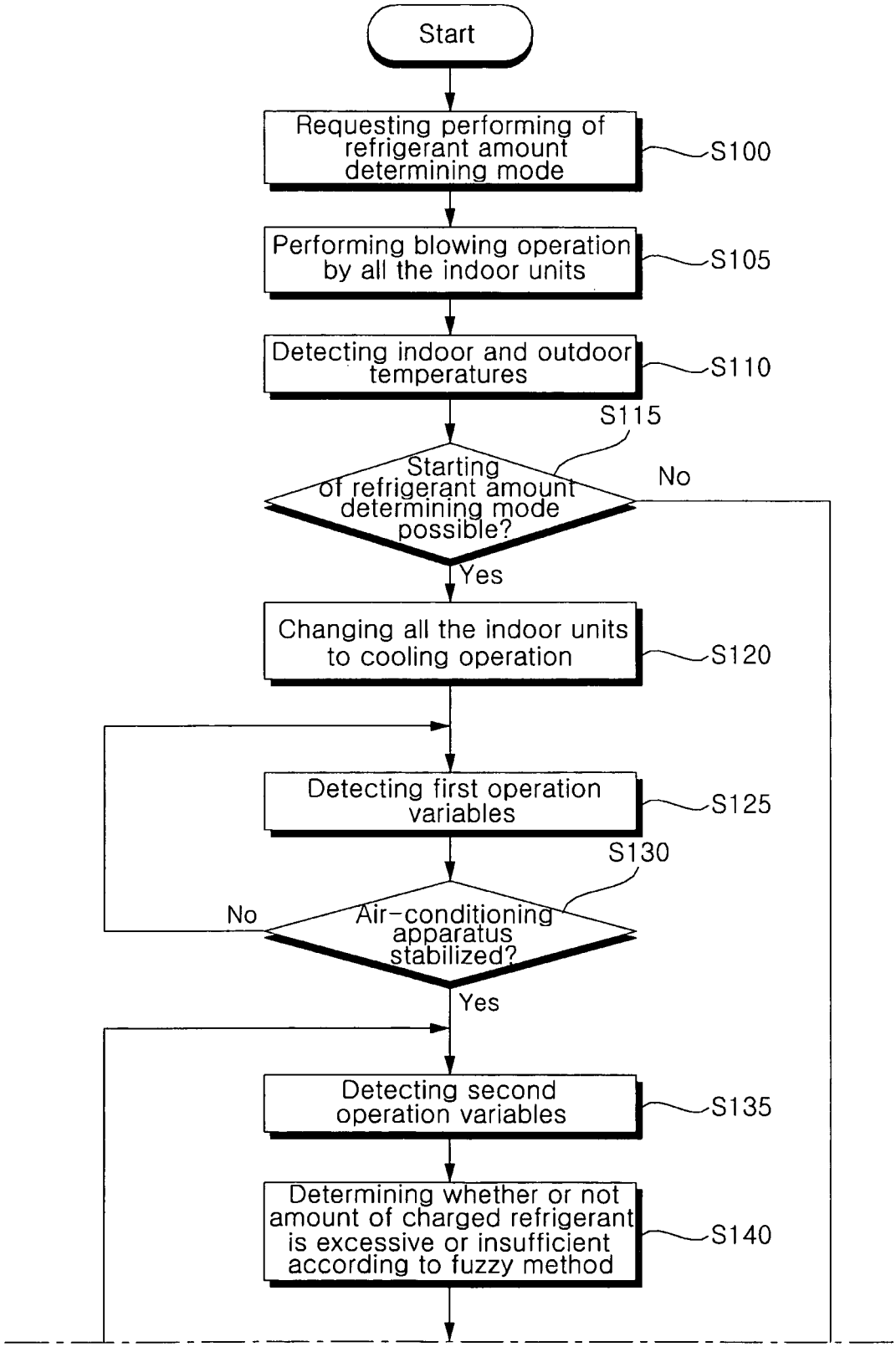
FIG. 4 is a flow chart illustrating a control flow of the refrigerant amount determining method of the air-conditioning apparatus according to an embodiment of the present invention.
Figure 4:
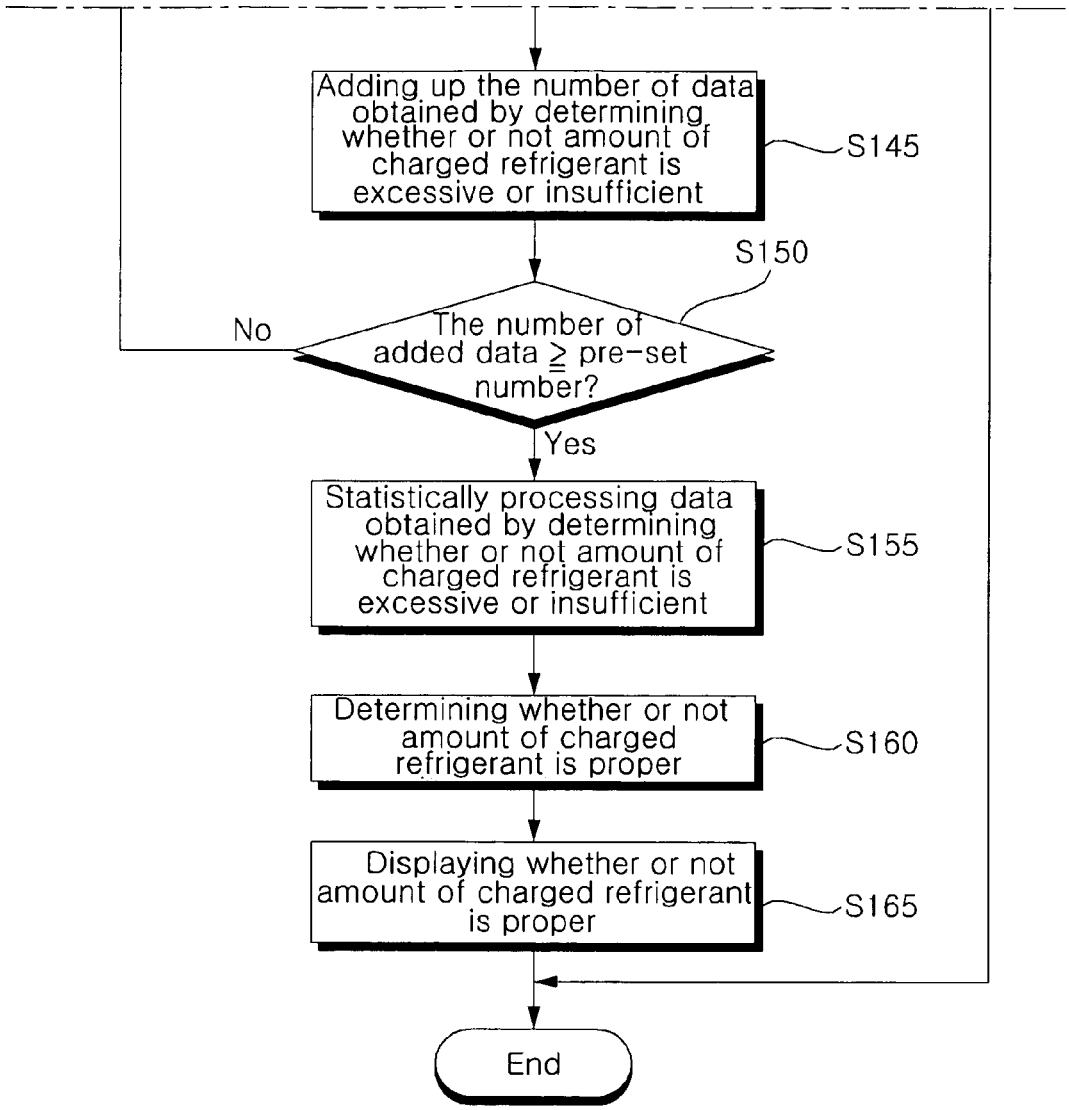

FIG. 4 is a flow chart illustrating a control flow of the refrigerant amount determining method of the air-conditioner according to an embodiment of the present invention. With reference to FIG. 4, first, a required for performing of a refrigerant amount determining mode to determine whether or not the refrigerant charged in the air-conditioner 100 is proper is received from a user (S100). The controller (not shown) is installed in the OU, and the user requests performing of the refrigerant amount determining mode by using an input device (not shown).

When the refrigerant amount determining mode is requested to be performed, the OU and all the IUs perform blowing operation (S105). While the blowing operation is performed, the indoor expansion valves 131 and the outdoor expansion valves 1332 are closed, so the refrigerant is not introduced into the IUs. Meanwhile, indoor air blowers 125 are operated. After the blowing operation is performed for longer than a pre-set time, indoor and outdoor temperatures are received from the indoor temperature sensors 176 and the outdoor temperature sensor 177. If the indoor and outdoor temperatures are within pre-set temperature ranges, it is determined that the refrigerant amount determining mode can be started (S115). If the indoor temperature is lower than a temperature at which cooling operation can be performed by using the air-conditioner 100 or if the outdoor temperature is higher than a temperature at which the air-conditioner 100 can be operated, operation itself of the air-conditioner is not possible. Thus, it is required to determine whether or not the air-conditioner 100 can be operated by comparing the indoor and the outdoor temperatures with the pre-set temperature ranges. In this case, it may be determined that the refrigerant amount determining mode can be started only when all the outdoor and indoor temperatures as received satisfy the pre-set temperature ranges. Also, it may be determined that the refrigerant amount determining mode can be started only when a pre-set rate (or a pre-set number) of outdoor and indoor temperatures satisfies the pre-set temperature range.

When it is determined that the refrigerant amount determining mode can be started, the air-conditioner 100 is changed to perform the all-room cooling operation under a pre-set condition (S120). However, the air-conditioner 100 may be changed to perform the all-room heating operation under a certain condition.

While the all-room cooling operation is performed, first operation variables are detected (S125) to determine whether or not the air-conditioner 100 has been stabilized (S130). The first operation variables include an all-room cooling operation time (time period or duration), an operation frequency of the compressor 110, the difference between a target low pressure and a current low pressure, and the difference between a condensation temperature and the liquid pipe temperature. The stable state is determined depending on whether or not the first operation variables satisfy stabilization conditions. Namely, the all-room cooling operation time should be longer than a pre-set time, a variation value of the frequency of the compressor 110 should be smaller than a pre-set value during a pre-set time, the difference between the target low pressure and the current low pressure should be maintained below a pre-set value during a pre-set time, and the difference between the condensation temperature and the liquid pipe temperature should be larger than a pre-set value. Here, the operation frequency of the compressor 110 is detected from information received from the frequency sensor 188. The current low pressure is a current evaporation pressure which is detected from an average pressure detected by the indoor pressure sensors 152. The condensation temperature is calculated as a saturation temperature corresponding to the pressure detected by the outdoor pressure sensor 153, and the liquid pipe temperature is detected from information detected by the liquid pipe temperature sensor 174. If the first operation variables do not satisfy the stabilization conditions during the pre-set time, whether or not the stabilization conditions are met can be detected again by setting and adjusting the number of target overheating degree of indoor units. However, in the present invention, the stabilization determining is not limited to the stabilization conditions with respect to the first operation variables, and whether or not the air-conditioner 100 is stable can be determined in consideration of various other operation variables.

When the air-conditioner 100 is determined to be in a stable state, it starts to determine whether or not the amount of charged refrigerant is substantially proper by using a fuzzy method. This will now be described in detail.

In the fuzzy method, a conclusive variable and a conditional variable are determined, and the conclusive variable is calculated by using a fuzzy rule and a membership function of the conditional variable. In this embodiment, the conclusive variable is data for determining whether or not the charged refrigerant is excessive, proper, and insufficient.

First, second operation variables are detected (S135). The second operation variables are conditional variables and can be variably determined. In this case, the second operation variables refer to variables which are not much influenced by an installation environment such as an installation position, a pipe length, or the like, of the air-conditioner 100. If the second operation variables are severely changed according to the installation environment of the air-conditioner 100, the membership functions of the second operation variables should be changed according to the installation environment. Then, determining whether or not the amount of charged refrigerant is proper is not general. In addition, experimentation information is drastically increased to set the membership functions.

In this embodiment, the second operation variables include the operation frequency of the compressor 110, a discharge pressure of the compressor 110, a supercooling degree of the refrigerant, a flow bypassed from the supercooler 180, an indoor temperature, an outdoor temperature, an evaporation temperature, and a condensation temperature. The discharge pressure of the compressor is detected from information received from a discharge pressure sensor. The supercooling degree of the refrigerant is defined as the difference between the condensation temperature and the liquid pipe temperature. The condensation temperature is calculated as a saturation temperature with respect to the pressure detected by the outdoor pressure sensor 153. The liquid pipe temperature is detected by the liquid pipe temperature sensor 174. The flow bypassed from the supercooler 180 is detected with information received from the bypass flowmeter 183. The method for detecting the operation frequency of the compressor 110, the supercooling degree, the indoor temperature, the outdoor temperature, and the evaporation temperature has been described.

The characteristics of the second operation variables are as follows. When the amount of refrigerant is insufficient while the cooling operation is performed, the supercooling degree is reduced due to the shortage of the amount of condensed refrigerant in the outdoor heat exchanger 140, increasing an opening degree of the supercooling expansion valve 182. Accordingly, the amount of refrigerant introduced into the IUs is reduced, the discharge temperature of the compressor 110 is increased, and thus, a discharge overheating degree is increased. However, if the amount of refrigerant is excessive, the supercooling degree is increased to reduce the opening degree of the supercooling expansion valve 182, and the discharge overheating degree of the compressor 110 is increased as the motor (not shown) for driving the compressor 110 is increasingly heated. As stated above, the membership functions may be determined by analyzing thermodynamic cycles of the indoor and outdoor temperatures as well as the supercooling degree and by fuzzy data based on various experimentations.

Figure 5:
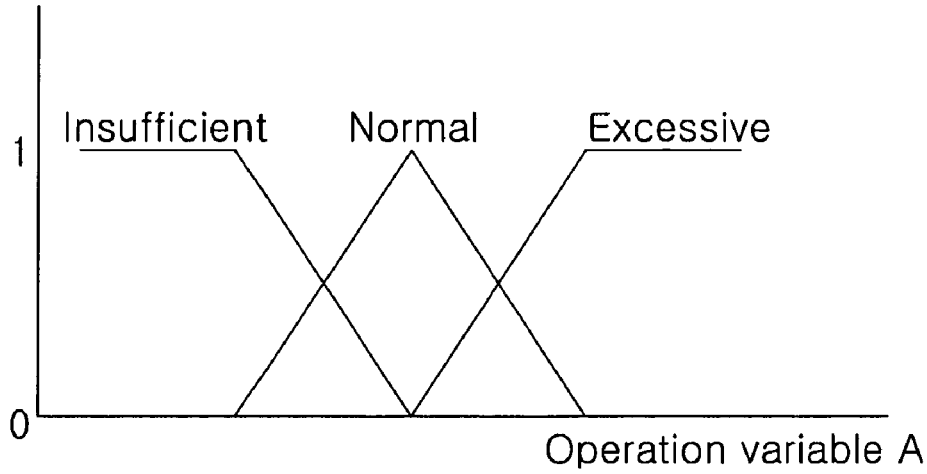
FIG. 5 is a graph schematically showing a membership function of an operation variable 'A' of the air-conditioner as shown in FIG. 1.
Figure 6:
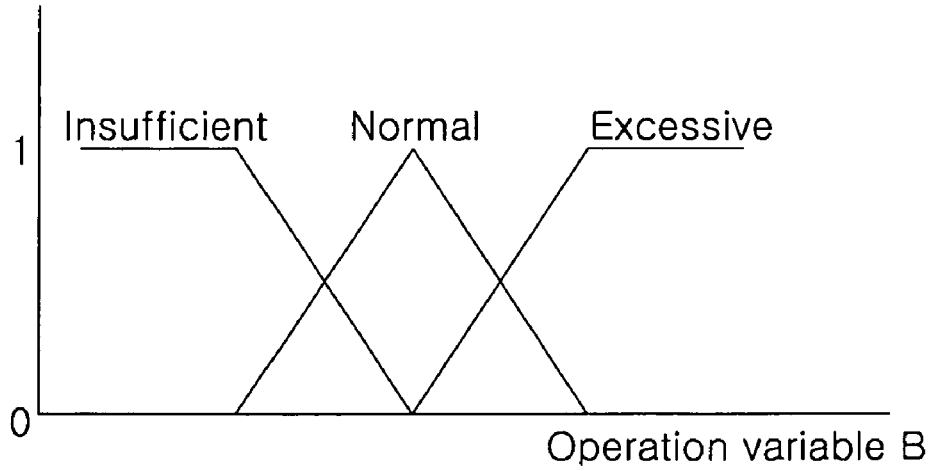
FIG. 6 is a graph schematically showing a membership function of an operation variable 'B' of the air-conditioner as shown in FIG. 1.

Membership functions of two arbitrary ones of the second operation variables are illustrated in FIGS. 5 and 6. As described above, the membership functions are previously set by analyzing the thermodynamic cycles and by experimentations. Table 1 shows the fuzzy rule of the two arbitrary operation variables. With reference to Table 1, only when the operation variables 'A' and 'B' are insufficient, the amount of charged refrigerant is determined to be insufficient, only when the operation variables 'A' and 'B' are normal, the amount of charged refrigerant is determined to be normal, and only when the operation variables 'A' and 'B' are excessive, the amount of charged refrigerant is determined to be normal.

TABLE 1

| | A | | |
|---|---|---|---|
| B | Insufficient | Normal | Excessive |
| Insufficient | Insufficient | Unknown | Unknown |
| Normal | Unknown | Normal | Unknown |
| Excessive | Unknown | Unknown | Excessive |

While the air-conditioner 100 performs the all-room cooling operation, calculating data for determining whether or not the amount of refrigerant charged the air-conditioner is excessive, normal, and insufficient by using the fuzzy rule and the member ship functions with respect to the second operation variables is repeatedly performed (S140), and the data are stored. The number of data is added up (S145). If the number of added data is larger than a pre-set number (S150), the data is statistically processed (S155) to determine whether or not the refrigerant charged in the air-conditioner is proper (S160). The final determination is 'insufficient', 'normal', 'excessive', and 'unknown' with respect to the charged refrigerant. 'Insufficient' indicates that the refrigerant charged in the air-conditioner 100 is not sufficient, 'normal' indicates that the refrigerant charged in the air-conditioner is proper, 'excessive' indicates that the refrigerant charged in the air-conditioner is excessive, and 'unknown' indicates that determining whether or not the refrigerant charged in the air-conditioner is insufficient or sufficient is not possible. The final determination is displayed on a display unit (not shown) (S165).

When the user visually checks the shortage information of the charged refrigerant, the user may charge the refrigerant to the air-conditioner 100. In addition, if the user visually checks the excess information of the charged refrigerant, he may remove a portion of the refrigerant from the air-conditioner 100.

As described above, because the air-conditioner is first stabilized and then the amount of charged refrigerant is automatically determined according to the fuzzy method, the amount of the charged refrigerant can be precisely determined. In addition, because the second operation variables, which are not much affected by the installation environment of the air-conditioner 100, are used, it is easy to set the membership functions and they can be applicable for air-conditioners of various installation environments.

The preferred embodiments of the present invention have been described with reference to the accompanying drawings, and it will be apparent to those skilled in the art that various modifications and variations can be made in the present invention without departing from the scope of the invention. Thus, it is intended that any future modifications of the embodiments of the present invention will come within the scope of the appended claims and their equivalents.

What is claimed is:

1. A method of determining an amount of refrigerant in an air-conditioning apparatus, comprising:

operating the air-conditioning apparatus according to a first mode of operation, wherein the first mode of operation comprises a blowing mode;

changing the operation of the air-conditioning apparatus from the first mode of operation to a second mode of operation, different from the first mode, wherein changing the operation of the air-conditioner does not occur before:

the air-conditioner apparatus is operated in the blowing mode for at least a pre-set length of time, an indoor temperature is within a pre-set indoor temperature range, and an outdoor temperature is within a pre-set outdoor temperature range;

detecting a first operational variable which is used to determine whether the air-conditioning apparatus has stabilized; and detecting a second operational variable which is used to determine the amount of refrigerant in the air-conditioning apparatus.

2. The method of claim 1, wherein the second mode of operation is an all-room operation mode, wherein all indoor units of the air-conditioning apparatus are operated for cooling or all indoor units of the air-conditioning apparatus are operated for heating.

3. The method of claim 1, further comprising:

detecting the first operational variable of the air-conditioning apparatus, after changing the operation of the air-conditioning apparatus.

4. The method of claim 1, wherein the first operational variable comprises at least one of an all-room cooling operation time, an operation frequency of a compressor, a difference between a target low pressure and a current low pressure, and a difference between a condensation temperature and a temperature of a liquid pipe.

5. The method of claim 1, wherein detecting the second operational variable is performed when the first operational variable is within a pre-set range.

6. The method of claim 1, wherein the second operational variable comprises at least one of an operation frequency of a compressor, a discharge pressure of the compressor, a supercooling degree of a refrigerant, a flow amount bypassed from a supercooler, an indoor temperature, an outdoor temperature, an evaporation temperature, and a condensation temperature.

7. The method of claim 1, further comprising:

determining whether the refrigerant amount charged in the air-conditioning apparatus is within a pre-set range by using fuzzy data previously stored with respect to the detected second operational variable.

8. The method of claim 7, further comprising:

visually displaying an indication of either:

the refrigerant amount charged in the air-conditioning apparatus is within a pre-set range; or the refrigerant amount charged in the air-conditioning apparatus is not within a pre-set range.

9. An air-conditioning apparatus comprising:

a compressor configured to discharge a refrigerant;

a condenser configured to condense the refrigerant discharged from the compressor;

a supercooler configured to bypass a portion of the flow of the condensed refrigerant, to throttle the bypassed portion of the flow of the refrigerant, and to receive the refrigerant again in order to supercool the refrigerant which has been condensed by the condenser; and an evaporator configured to throttle and to evaporate the refrigerant introduced from the supercooler, wherein the compressor, the condenser, the supercooler, and the evaporator are configured to operate in a first mode of operation and then change to a second mode of operation, different from the first mode, wherein the first mode of operation comprises a blowing mode, and wherein the mode of operation is not changed from the first mode to the second mode of operation until, at least:

the air-conditioner apparatus is operated in the blowing mode for at least a pre-set length of time, an indoor temperature is within a pre-set indoor temperature range, and an outdoor temperature is within a pre-set outdoor temperature range;

at least one detector coupled to at least one of the compressor, the condenser, the supercooler, and the evaporator, wherein the at least one detector is configured to detect the first operational variable that is used to determine whether the air-conditioning apparatus has stabilized; and wherein the at least one detector is configured to detect a second operational variable that is used to determine an amount of refrigerant in the air-conditioning apparatus.

10. The apparatus of claim 9, further comprising a plurality of indoor units, wherein the second mode of operation is an all-room operation mode, wherein all indoor units of the air-conditioning apparatus are operated for cooling or all indoor units of the air-conditioning apparatus are operated for heating.

11. The apparatus of claim 9, wherein the first operational variable comprises at least one of an all-room cooling operation time, an operation frequency of a compressor, a difference between a target low pressure and a current low pressure, and a difference between a condensation temperature and a temperature of a liquid pipe.

12. The apparatus of claim 9, wherein the second operational variable is detected when the first operational variable is within a pre-set range.

13. The apparatus of claim 9, wherein the second operational variable comprises at least one of the operation frequency of the compressor, a discharge pressure of the compressor, a supercooling degree of the refrigerant, a flow amount bypassed from a supercooler, an indoor temperature, an outdoor temperature, an evaporation temperature, and a condensation temperature.

14. The apparatus of claim 9, wherein the detected second operational variable is used to determine whether the refrigerant amount charged in the air-conditioning apparatus is within a pre-set range by using previously stored fuzzy data.

15. The apparatus of claim 14, further comprising a display unit configured to visually display an indication of either:

the refrigerant amount charged in the air-conditioning apparatus is within a pre-set range; or the refrigerant amount charged in the air-conditioning apparatus is not within a pre-set range.

* * * * *